United States Patent [19]

Snelling

[11] Patent Number: 4,804,996

[45] Date of Patent: Feb. 14, 1989

[54] CHARGED PARTICLE SENSOR HAVING MAGNETIC FIELD CONTROL

[75] Inventor: Christopher Snelling, Penfield, N.Y.

[73] Assignee: Xerox Corporation, Stamford, Conn.

[21] Appl. No.: 622,810

[22] Filed: Jun. 21, 1984

[51] Int. Cl.[4] ..... G03G 15/09; G03G 21/00

[52] U.S. Cl. ..... 355/3 DD; 118/688

[58] Field of Search ..... 355/3 R, 3 DD; 118/688, 118/689, 690, 691

[56] References Cited

U.S. PATENT DOCUMENTS

| | | | |
|---|---|---|---|
| 4,181,441 | 1/1980 | Noller | 356/414 |
| 4,195,260 | 3/1980 | Sakamoto et al. | 324/204 |
| 4,371,257 | 2/1983 | Nishikawa | 355/14 D |
| 4,431,300 | 2/1984 | Snelling | 355/14 D |
| 4,447,145 | 5/1984 | Snelling et al. | 355/14 D |

FOREIGN PATENT DOCUMENTS

| | | |
|---|---|---|
| 86594 | 8/1983 | European Pat. Off. . |
| 57-108641 | 7/1982 | Japan . |
| 59-93472 | 5/1984 | Japan . |

*Primary Examiner*—Fred L. Braun

*Attorney, Agent, or Firm*—H. Fleischer; J. E. Beck; R. Zibelli

[57] ABSTRACT

An apparatus in which the developability of electrostatically charged particles in a mixture of particulate material is measured. The apparatus includes a transparent member positioned closely adjacent to a developer roller of an electrophotographic printing machine. A brush of particles is formed adjacent the member in one mode of operation, while, in another mode of operation, a cloud of particles is formed adjacent the member. A portion of the charged portions are attracted to the member. A beam of energy is transmitted through the member with the internal angle of incidence being greater than the critical angle of incidence of the member. The intensity of the internally reflected beam is detected and a signal generated indicative of the quantity of charged particles adhering to the member.

20 Claims, 3 Drawing Sheets

CHARGED PARTICLE SENSOR HAVING MAGNETIC FIELD CONTROL

This invention relates generally to an electrophotographic printing machine, and more particularly concerns an apparatus for sensing electrostatically charged particles in a mixture of particulate material.

Generally, the process of electrophotographic printing include charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is heated to permanently affix it to the copy sheet in image configuration.

A common type of developer mixture frequently used in electrophotographic printing machines comprises carrier granules having toner particles adhering triboelectrically thereto. This two-component mixture is brought into contact with the photoconductive surface. The toner particles are attracted from the carrier granules to the latent image. During usage, toner particles are depleted from the developer mixture and must be periodically replenished therein. Heretofore, the concentration of toner particles in the developer mixture was controlled within a pre-selected limit. However, in electrophotographic printing machines it is desirable to achieve optimum developability rather than merely maintaining the concentration of the toner particles within the developer mixture at a substantially constant level. In order to achieve optimum developability, the output density of the copy should correspond substantially to the input density of the original document. This may be achieved by regulating the developability of the developer mixture. Developability is related to environmental conditions such as temperature and humidity, as well as the concentration of toner particles within the developer material. Other physical parameters of the development system also affect developability, i.e. spacing, electrical bias, mass flow rate, and the magnetic flow pattern, amongst others. In addition, many other factors such as state of compaction of the developer material, the charge on the toner particles and carrier granules, as well as the state of attraction of the toner particles to the carrier granules all influence developability. Heretofore, it has been found that the location of the magnetic poles on a developer roller influence the measurement of developability by a sensor. Furthermore, it is desirable, not only to measure the developability of the magnetic brush formed but, to determine the air borne particles in the vicinity of the magnetic brush under the condition of relaxed or no magnetic brush contact with the sensor. The magnitude of the air borne charged particles detected in this latter condition provides information indicative of overaged or overtoned developer material. This information is useful for enhanced system operation.

Various techniques have been devised for measuring developability. The following disclosures appear to be relevant:

U.S. Pat. No. 4,431,300, Patentee: Snelling, Issued: Feb. 14, 1984

U.S. Pat. No. 4,447,145, Patentee: Snelling et al., Issued: May 8, 1984

The relevant portions of the foregoing disclosures may be briefly summarized as follows:

Snelling discloses a substantially transparent prism having an electrically conductive layer on one surface thereof electrically biased to attract toner particles from a developer roller. A light source transmits light rays through the prism onto the toner particles attracted thereto. The intensity of the internally reflected light rays are detected by a photosensor. The output signal from the photosensor is used to control the dispensing of toner particles into the developer mixture.

Snelling et al. discribes an apparatus having a pair of spaced-apart conductive plates through which a portion of the developer material flows. One of the plates is transparent with a prism being secured thereto. The transparent plate is electrically biased to attract toner particles thereto. A light source transmits light rays through the transparent plate and prism. The intensity of the internally relected light rays are detected by a photosensor to provide a measurement of the quantity of toner particles adhering to the transparent plate. A magnet is positioned on the side of the prism opposed from the transparent plate for increasing the attraction of the toner particles to the plate.

In accordance of one aspect of the present invention, there is provided an apparatus for sensing electrostatically charged particles. The apparatus includes a member adapted to attract at least a portion of the charged particles to at least one surface thereof. Means form a brush of particles adjacent the member in one mode of operation and a cloud of particles adjacent the member in another mode of operation. Means are provided for transmitting a beam of energy through the member onto the charged particles attracted to the surface thereof. The internal angle of incidence of the beam of energy is greater than the critical angle of incidence of the member. Means detect the intensity of the beam of energy internally reflected through the member and generate a signal indicative of the quantity of charged particles attracted to the surface of the member.

Pursuant to another aspect of the present invention, there is provided an electrophotographic printing machine of the type having a developer roller for transporting a developer mixture comprising electrostatically charged particles closely adjacent to an electrostatic latent image recorded on a photoconductive member. The electrostatically charged particles develop the latent image. The printing machine includes a member, positioned closely adjacent to the developer roller, adapted to attract at least a portion of the charged particles to at least one surface thereof. Means form a brush of particles adjacent to the member in one mode of operation and form a cloud of particles adjacent the member in another mode of operation. Means are provided for transmitting a beam of energy through the member onto the charged particles attracted to the surface thereof. The internal angle of incidence of the beam of energy is greater than the critical angle of incidence of the member. Means detect the intensity of the beam of energy internally reflected throught the member and generate a signal indicative of the quantity of charged particles attracted to the surface of the member.

Other features of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
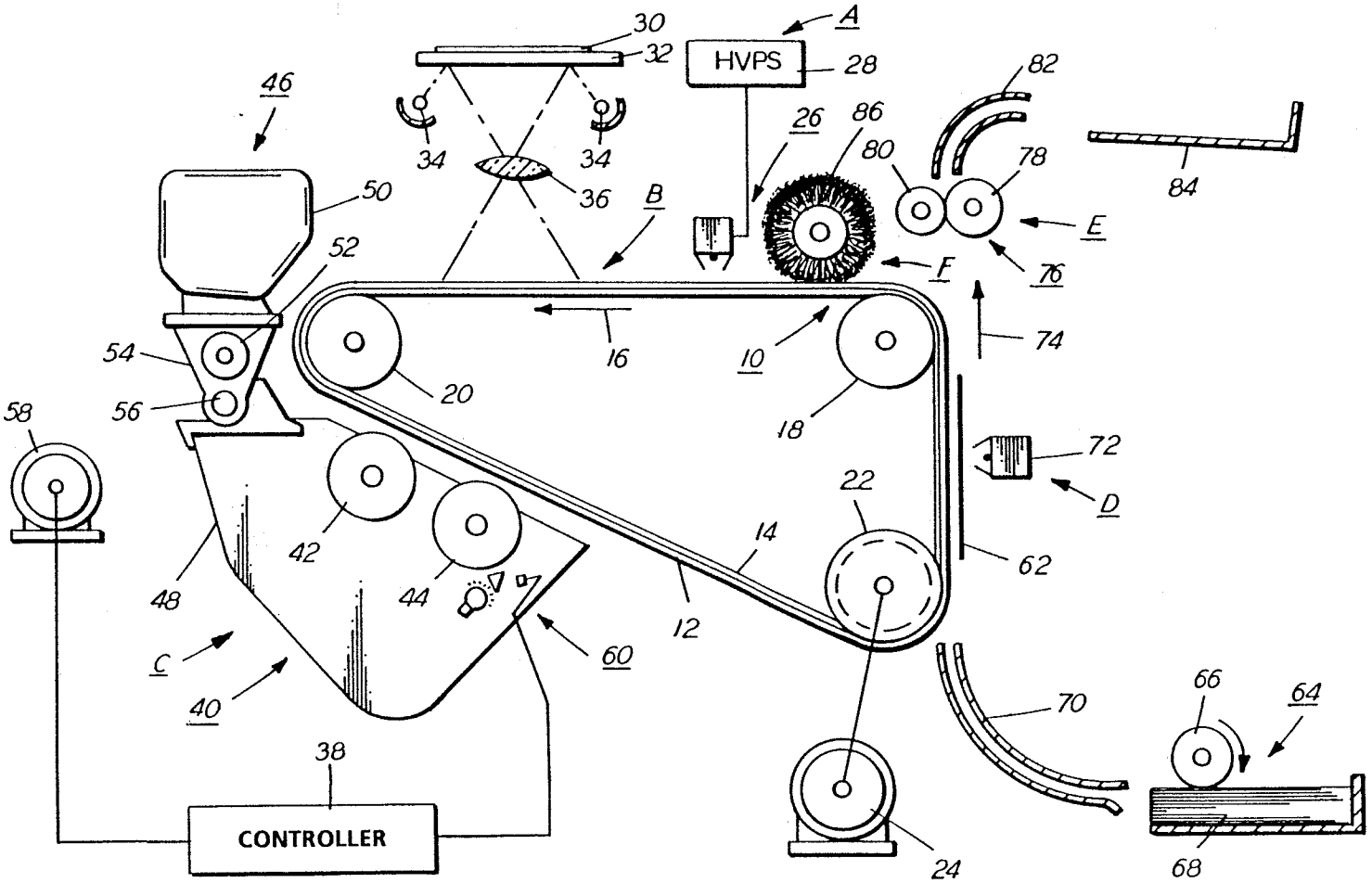
FIG. 1 is a schematic elevational view of an illustrative electrophotographic printing machine incorporating the apparatus of the present invention therein.

Referring now to FIG. 1, the electrophotographic printing machine employs a belt 10 having a photoconductive surface 12 deposited on a conductive substrate 14. Preferably, photconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means such as a belt drive. Drive roller 22 includes a pair of opposed spaced edge guides. The edge guides define a space therebetween which determines the desired path of movement of belt 10. Belt 10 is maintained in tension by a pair of springs (not shown) resiliently urging tensioning roller 20 against belt 10 with the desired spring force. Both stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high substantially uniform potential. High voltage power supply 28 is coupled to corona generating device 26. Excitation of power supply 28 causes corona generating device 26 to charge photoconductive surface 12 of belt 10. After photoconductive surface of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 40, advances developer material into contact with the latent image. Preferably, magnetic brush development system 40 includes two magnetic brushdeveloper rollers 42 and 44. Rollers 42 and 44 advance developer material into contact with the latent image. These developer rollers form a brush of carrier granules and toner particles extending outwardly therefrom. The latent image attracts toner particles from the carrier granules forming a toner powder image thereon. Preferably, the developer material is electrically conductive. As successive electrostatic latent images are developed, toner particles are depleted from the developer material. A toner particle dispenser, indicated generally by the reference numeral 46, includes a container 50 storing a supply of toner particles therein. Foam roller 52 disposed in chamber 54 beneath container 50, meters toner particles into auger 56. Motor 58 is coupled to auger 56. As motor 58 rotates auger 56 advances toner particles for discharge into developer housing 48. Energization of motor 58 is regulated by controller 38. A sensor, indicated generally by the reference numeral 60, is positioned closely adjacent to developer roller 44. The detailed structure of sensor 60 will be described hereinafter with reference to FIGS. 2 through 5, inclusive. Sensor 60 is coupled to controller 38 which develops an error signal to actuate motor 58 to dispense toner particles into developer housing 48. Thus, when the developability, as measured by sensor 60, is beneath a predetermined level, controller 38 actuates motor 58 to dispense additional toner particles into the developer material. The dispensing of additional toner particles into the developer material adjusts the developability of the system to the desired level. One skilled in the art will appreciate that sensor 60 may be disposed adjacent to developer roller 42 in lieu of roller 44.

After the electrostatic latent image is developed, belt 10 advances the toner powder image to transfer station D. A sheet of support material 62 is advanced to transfer D by sheet feeding apparatus 64. Preferably, sheet feeding apparatus 64 includes a feed roll 66 contacting the uppermost sheet of stack 68. Feed roller 66 rotates to advance the uppermost sheet from stack 68 into chute 70. Chute 70 directs the advancing sheet of support material into contact with photoconductive surface 12 of belt 10 in a timed sequence so that the toner powder image formed thereon contacts the advancing sheet of support material at transfer station D. Transfer station D includes a corona generating device 72 which sprays ions onto the backside of sheet 62. This attracts the toner powder image from photoconductive surface 12 to sheet 62. After transfer, sheet 62 continues to move in the direction of arrow 74 onto a conveyor (not shown) which advances sheet 62 to fusing station E.

Fusing station E includes a fuser assembly indicated generally by the reference numeral 76, which permanently affixes the transferred powder image to sheet 62. Preferably, fuser assembly 76 comprises a heated fuser roller 78 and a back-up roller 80. Sheet 62 passes between fuser roller 78 and back-up roller 80 with the toner powder image contacting fuser roller 78. In this manner, the toner powder image is permanently affixed to sheet 62. After fusing, chute 82 advances sheet 62 to catch tray 84 for subsequent removal from the printing machine by the operator.

After the sheet of support material is separated from photoconductive surface 12 of belt 10, the residual toner particles adhering to photoconductive surface 12 are removed therefrom at cleaning station F. Cleaning station F includes a rotatably mounted fiberous brush 86 in contact with photoconductive surface 12. The particles are cleaned from photoconductive surface 12 by the rotation of brush 86 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
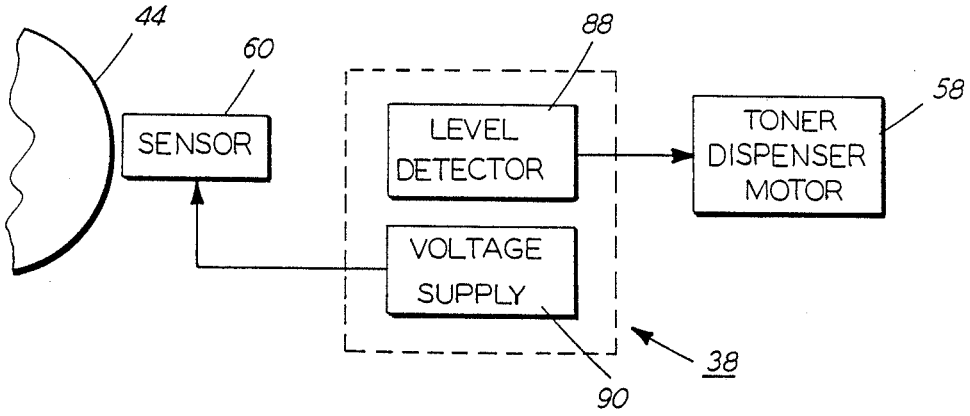
FIG. 2 is a block diagram of a control system used to regulate the developability of the developer mixture employed in the FIG. 1 printing machine.

Referring now to FIG. 2, sensor 60 is disposed closely adjacent to developer roller 44. As developer roller 44 transports developer material into contact with the latent image recorded on photoconductive surface 12, sensor 60 is also developed with toner particles. The quantity of toner particles is detected and an electrical output signal generated indicative thereof. Controller 38 receives an electrical output signal from sensor 60 and processes it. Controller 38 includes a level detector 88 and a voltage supply 90. Voltage supply 90 is coupled to sensor 60 so as to furnish the appropriate electrical bias thereto. By way of example, level detector 88 includes logic elements to process the electrical signal from sensor 60. The logic elements include, preferably, a suitable discriminator circuit for comparing a reference with the electrical output signal from sensor 60. The discriminator circuit may utilize a silicon control switch which turns on and effectively locks in after an electrical output signal has been obtained having a magnitude greater than the reference level, (i.e. set point). The signal from the discriminator circuit changes the state of the flip-flop to develop an output signal therefrom. The output signal from the flip-flop, in conjunction with an output signal from the developer unit actuates an AND gate which, in turn, transmits a control signal to toner dispenser motor 58. The control signal also resets the flip-flop. This type of logic circuit is on-off. However, in the alternative, it is possible to utilize proportional circuitry which varies the quantity of toner particles needed to the developer unit as a function of the control signal. This may be achieved by a suitable integrated circuit module for developing a stepped proportional dispensing signal.

Figure 3:
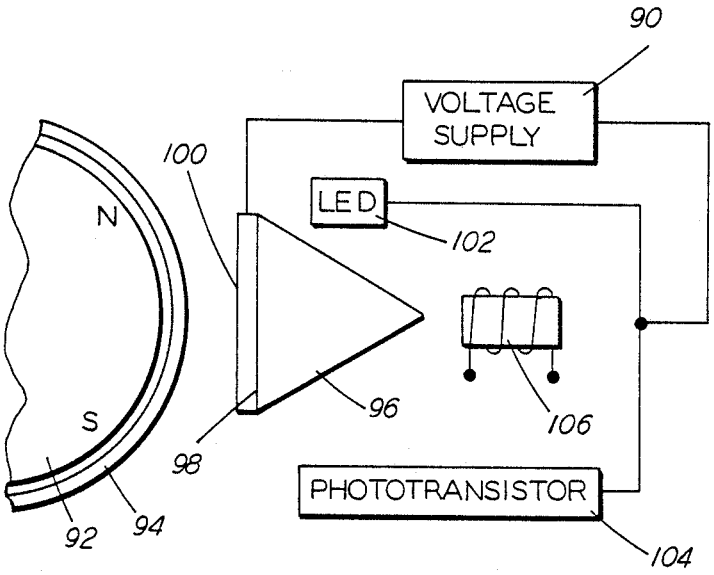
FIG. 3 is a schematic elevational view of the FIG. 2 sensor and its relationship to the magnetic poles of the developer roller in one mode of operation.

Turning now to FIG. 3, sensor 60 is shown positioned relative to the magnetic poles of magnet 92 disposed interiorly of tubular member 94 of developer roller 44. Sensor 60 includes a prism 96 which is preferably a right triangular prism, with the hypotenuse, i.e. surface 98, having a substantially transparent electrically conductive layer 100 adhering thereto. Prism 96 is positioned so as to be interposed between adjacent poles of magnetic member 92. In this configuration, prism 96 is located between adjacent magnetic poles of magnet 92. Preferably, electrically conductive layer 100 is a transparent tin oxide coating which is made by Pittsburgh Plate Glass under the Trademark "NESA" or is made by the Corning Glass Company under the Trademark "Electroconductive". The angles of transparent prism 96 opposed from the legs are equal and 45°. Voltage source 90 is coupled to electrically conductive layer 100 so as to electrically bias the surface of prism 96, thereby attracting toner particles being transported on developer roller 44 thereto. Light source 102 is preferably a light emitting diode with light detector 104 preferably being a phototransistor. Light emitting diode 102 and phototransistor 104 are coupled to voltage source 90 through suitable circuitry. The characteristics of this circuitry depend upon the type of light emitting diode or phototransistor used. Preferably, the light emitting diode operates in the far infared region and uses a lens to define the spot. Light emitting diode 102 directs light rays through prism 96. The internally reflected light rays which pass through prism 96 are sensed by phototransistor 104 which, in turn, generates an electrical output signal. An electromagnet 106 is positioned adjacent the apex of prism 96. When electromagnet 106 is energized with the proper polarity to attract the developer material on developer roller 44, a brush of developer material is formed adjacent surface 100 of prism 96. This brush of developer material developes surface 100. Alternatively, when electromagnet 106 is de-energized a cloud of toner particles is formed adjacent surface 100 of prism 96 due to mechanical agitation. The magnitude of airborne toner detected under this condition provides information indicative of overaged or overtoned developer material. Thus, when electromagnet 106 is energized with prism 96 positioned between adjacent magnetic poles of magnet 92, a brush of developer material is formed contacting surface 100 of prism 96 and the output therefrom is indicative of the developability of the developer material. When electromagnet 106 is de-energized, a toner cloud is formed and the output signal corresponds to the overaged or overtoned condition of the material.

Figure 4:
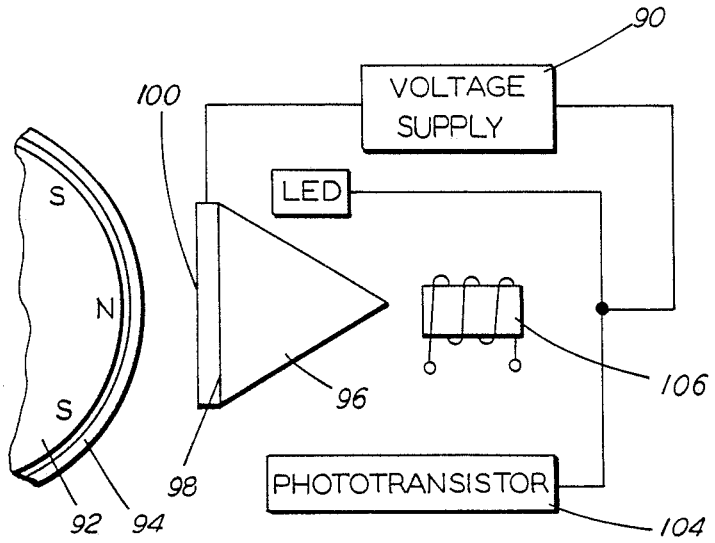
FIG. 4 is a schematic elevational view illustrating the FIG. 2 sensor and its relationship to the magnetic poles of the developer roller in another mode of operation.

Referring now to FIG. 4, sensor 60 is positioned such that prism 96 is opposed from a magnetic pole of magnet 92 of developer roller 44. In this position, when electromagnet 106 is de-energized, a brush of developer material is formed contacting conductive layer 100 on surface 98 of prism 96. Alternatively, when electromagnet 106 is energized with the proper polarity to oppose the magnetic field of magnet 92 at developer roller 44, a cloud of toner particles is formed in the gap adjacent conductive layer 100. Thus, when sensor 60 is positioned opposed from a magnetic pole of magnet 92 of developer roller 94, electromagnet 106 is de-energized in order to determine the developability characteristics of the developer material. When information regarding the aging or toned condition of the developer material is desired, electromagnet 106 is energized and a cloud of toner particles is formed in the gap adjacent layer 100 on prism 96. Once again, light emitting diode 102 directs light rays through prism 96 and the internally reflected light rays are detected by phototransistor 102 which in turn, transmits a signal to controller 38. In this way, additional toner particles may be dispensed to the developer material or, the characteristics of the developer material determined.

In operation, light emitting diode 102 transmits light rays through prism 96. The internal angle of incidence of the light rays is greater than the critical angle of incidence of prism 96. Phototransistor 104 senses the change in internally reflected light rays. As toner particle deposition occurs on layer 100, the magnitude of the internally reflected light detected is reduced. Thus, the presence of toner particles on the surface of layer 100 causes a decrease in the detected light intensity which corresponds to a decrease in the internal reflectivity of the surface. The (internal) reflective radiation field extends beyond the face of surface 100 a distance on the order of a wave length of light. This is the exponentially decaying evanescent field. Thus, there are two categories of energy coupled through prism 96. One due to the intimate contact of the toner particles with layer 100 and the other due to the particles located near layer 100 mediated by the evanescent field. In the first case, the internal reflectivity of the prism is reduced by transmission into the toner particles, characterized by an index of refraction and an absorbtion coefficient. The second operates by an evanescent field coupling of energy from the surface of layer 100 to the toner particles rather than relying on intimate contact between the surface and the toner particles. It appears that the evanescent field effect dominates to produce the large signal sensitivity that has been found in this sensing apparatus.

Figure 5:
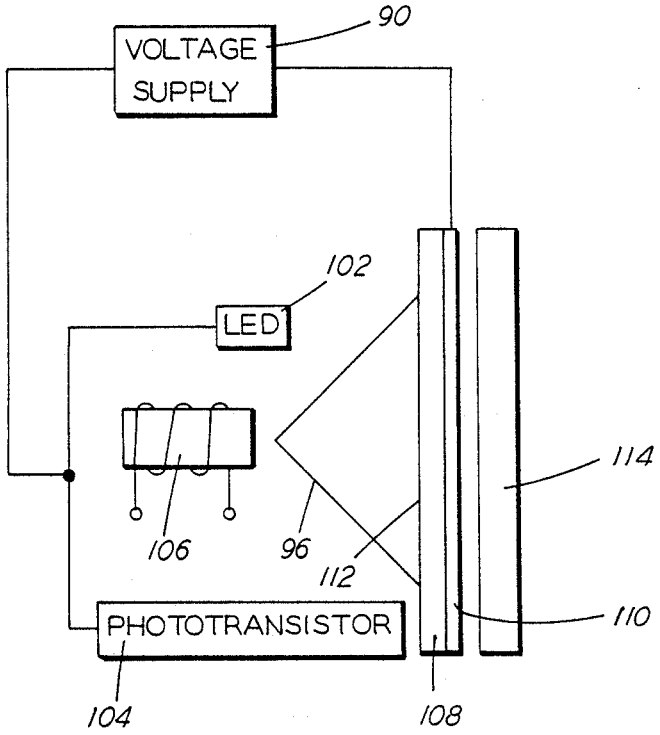
FIG. 5 is a schematic elevational view showing an alternate embodiment of the sensor.

Turning now to FIG. 5, there is shown an alternate embodiment of sensor 60 which is not required to be positioned adjacent to developer roller 44. As shown thereat, prism 60 has a substantially transparent plate 108 having an electrically conductive layer 110 adhering thereto. Plate 108 is secured to prism 96. Preferably, the hypotenuse of prism 96, i.e. surface 112, is secured to surface 108. Plate 114 is spaced from and parallel to plate 110 to define a passageway through which the developer mixture passes. Sensor 60 is angled such that the developer material is in contact with plate 114. Thus, when electromagnet 106 is de-energized only a cloud of developer material is formed in the gap between plate 108 and plate 114. However, upon energization of electromagnet 106, the developer material will move into contact with layer 110 on plate 108. Hence, the sensor acts in the development mode when electromagnet 106 is energized and in the toner cloud mode when electromagnet 106 is de-energized. In this way, the embodiment of sensor 60 depicted in FIG. 5 can determine the developability characteristics of the developer material as well as the aging or overtoned characteristics thereof.

In recapitulation, it is apparent that the sensing apparatus of the present invention utilizes an electromagnet to form either a cloud of charged particles or a brush of charged particles adjacent the sensor. When a brush of charged particles is formed the developability characteristics may be sensed. Alternatively, when a cloud of charged particles is formed, the overaged or overtoned condition of the developer material may be determined. In either mode of operation, the sensor measures the change in internal reflectance to provide a signal output therefrom. The signal may be employed to control the concentration of toner particles within the developer material, adjust charging and regulate the electrical bias applied to the developer roller, amongst others.

It is therefore, apparent that there has been provided in accordance with the present invention, an apparatus for sensing the characteristics of developer material employed in an electorphotographic printing machine. This apparatus fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for sensing electrostatically charged particles, including:

a member adapted to attract at least a portion of the charged particles to at least one surface thereof;

means for forming a brush of particles adjacent said member in one mode of operation and forming a cloud of particles adjacent said member in another mode of operation, said forming means including an electromagnet, said electromagnet being energized and de-energized as a function of the mode of operation thereof;

means for transmitting a beam of energy through said member onto the charged particles attracted to the surface thereof with the internal angle of incidence of the beam of energy being greater than the critical angle of incidence of said member; and means for detecting the intensity of the beam of energy internally reflected through said member and generating a signal indicative of the quantity of charged particles attracted to the surface of said member.

2. An apparatus according to claim 1, further including a pair of spaced apart conductive plates defining a passageway through which a portion of the charged particles flow with at least one of the plates being substantially transparent, said member being secured to one surface of said transparent plate, said electromagnet being energized to repel particles from the surface of said transparent plate and being de-energized to attract particles thereto.

3. An apparatus according to claim 1, wherein said member includes:

a substantially transparent prism; and a substantially transparent, electrically conductive layer adhering to one surface of said prism.

4. An apparatus according to claim 3, wherein said member includes means for electrically biasing said conductive layer to attract charged particles thereto.

5. An apparatus according to claim 4, wherein said prism is a right triangular prism having equal opposed interior angles.

6. An apparatus according to claim 5, wherein said conductive layer adheres to the surface of said prism opposed from theright angle thereof.

7. An apparatus according to claim 6, wherein said transmitting means includes a light source transmitting light rays through said prism and said conductive layer onto the charged particles adhering thereto.

8. An apparatus according to claim 7, wherein said detecting means includes a light sensor positioned to receive light rays internally reflected through said prism.

9. An apparatus according to claim 8, wherein:

said light source is a light emitting diode; and said light sensor is a phototransistor.

10. A printing machine according to claim 8, wherein:

said light source is a light emitting diode; and said light sensor is a phototransistor.

11. An electrophotographic printing machine of the type having a developer roller for transporting a developer mixture comprising at least electrostatically charged particles closely adjacent to an electrostatic latent image recorded on a photoconductive surface so as to develop the latent image with charged particles, wherein the improvement includes:

a member, positioned closely adjacent to the developer roller, adapted to attract at least a portion of the charged particles to at least one surface thereof;

means for forming a brush of particles adjacent said member in one mode of operation and forming a cloud of particles adjacent said member in another mode of operation, said forming means including an electromagnet, said electromagnet being energized and de-energized as a function of the mode of operation thereof;

means for transmitting a beam of energy through said member onto the charged particles attracted to the surface thereof with the internal angle of incidence of the beam of energy being greater than the critical angle of incidence of said member; and means for detecting the intensity of the beam of energy internally reflected through said member and generating a signal indicative of the quantity of charged particles attracted to the surface of said member.

12. A printing machine according to claim 11, wherein the developer roller includes a stationary magnet having a plurality of magnetic poles spaced from one another on the periphery thereof.

13. A printing machine according to claim 12, wherein said member is positioned between adjacent magnetic poles of the magnet of the developer roller, said electromagnet being energized to form a brush of developer mixture adjacent said member and being de-energized to form a cloud of charged particles adjacent said member.

14. A printing machine according to claim 12, wherein said member is positioned opposed from one of the magnetic poles of the magnet of the developer roller, said electromagnet being de-energized to form a brush of developer mixture adjacent said member and being energized to form a cloud of charged particles adjacent said member.

15. A printing machine according to claim 12, wherein said member includes:

a substantially transparent prism; and a substantially transparent, electrically conductive layer adhering to one surface of said prism.

16. A printing machine according to claim 15, wherein said member includes means for electrically biasing said conductive layer to attract charged particles thereto.

17. A printing machine according to claim 16, wherein said prism is a right triangular prism having equal opposed interior angles.

18. A printing machine according to claim 17, wherein said conductive layer adheres to the surface of said prism opposed from the right angle thereof.

19. A printing machine according to claim 18, wherein said transmitting means includes a light source transmitting light rays through said prism and said conductive layer onto the charged particles adhering thereto.

20. A printing machine according to claim 19, wherein said detecting means includes a light sensor positioned to receive light rays internally reflected through said prism.

* * * * *